US007126468B2

(12) United States Patent
Arling et al.

(10) Patent No.: US 7,126,468 B2
(45) Date of Patent: Oct. 24, 2006

(54) SYSTEM AND METHOD FOR MONITORING REMOTE CONTROL TRANSMISSIONS

(75) Inventors: Paul D. Arling, Irvine, CA (US); Wayne Scott, Newport Beach, CA (US); Christopher Chambers, Stanton, CA (US); Joseph Lee Haughawout, Aliso Viejo, CA (US)

(73) Assignee: Universal Electronics Inc., Cypress, CA (US)

( * ) Notice: Subject to any disclaimer, the term of this patent is extended or adjusted under 35 U.S.C. 154(b) by 374 days.

(21) Appl. No.: 10/665,650

(22) Filed: Sep. 19, 2003

(65) Prior Publication Data

US 2004/0266419 A1 Dec. 30, 2004

Related U.S. Application Data

(63) Continuation-in-part of application No. 10/603,839, filed on Jun. 25, 2003, now Pat. No. 7,005,979.

(51) Int. Cl.
*G08B 1/08* (2006.01)

(52) U.S. Cl. ..... 340/539.1; 340/825.22; 340/815.4; 370/394

(58) Field of Classification Search ..... 340/539.1, 340/825.72, 825.22, 825.69, 825.57, 825.56, 340/825.27, 815.4; 370/394
See application file for complete search history.

(56) References Cited

U.S. PATENT DOCUMENTS

| | | | | |
|---|---|---|---|---|
| 4,959,810 | A * | 9/1990 | Darbee et al. | 398/112 |
| 5,787,259 | A * | 7/1998 | Haroun et al. | 709/253 |
| 6,725,281 | B1 * | 4/2004 | Zintel et al. | 719/318 |
| 6,747,568 | B1 | 6/2004 | Teskey | 340/825.72 |
| 6,956,496 | B1 * | 10/2005 | Herz | 340/825.22 |
| 2002/0140571 | A1 | 10/2002 | Hayes et al. | 340/825.72 |
| 2003/0041335 | A1 * | 2/2003 | Patry et al. | 725/132 |

* cited by examiner

*Primary Examiner*—Phung T. Nguyen
(74) *Attorney, Agent, or Firm*—Gary R. Jarosik

(57) ABSTRACT

A remote control transmission monitoring system. The system monitors remote control transmissions for the purpose of updating state tables for one or more remotely controllable appliances. The state tables may then be queried for the purpose of determining the present state of an appliance whereby the transmission of a command that would place an appliance in an unintended state may be avoided.

64 Claims, 9 Drawing Sheets

| TV device (function) | State |
|---|---|
| power | 1 ("on") |
| volume | 6 ("volume up activated 6Xs") |
| mute | 0 ("off") |
| .<br>.<br>. | |

| VCR device (function) | State |
|---|---|
| power | 0 ("off") |
| play | 1 ("on") |
| FF | 0 ("not active") |
| .<br>.<br>. | |

FIGURE 4

SYSTEM AND METHOD FOR MONITORING REMOTE CONTROL TRANSMISSIONS

RELATED APPLICATION

This application is a continuation-in-part of commonly assigned, U.S. application Ser. No. 10/603,839, entitled "System and Method For Monitoring Remote Control Transmissions," filed on Jun. 25, 2003 now U.S. Pat. No. 7,005,979, the disclosure of which is hereby incorporated by reference in its entirety.

BACKGROUND

The following relates generally to remote control systems and, more particularly, relates to a system and method for monitoring remote control transmissions.

Devices adapted to unobtrusively monitor the tuning of a home entertainment center are known in the art. For example, U.S. Pat. No. 5,235,414 describes a device adapted to work with the remote controls of the various appliances that comprise the home entertainment center. The device functions to receive a signal from the remote controls, determine which appliance was the intended target of the signal, send an infrared signal to the intended target appliance, and store tuning information. In this manner, the stored information may be retrieved at a later time and used to determine program ratings.

While the system described in U.S. Pat. No. 5,235,414 performs adequately when it is only desired to simply monitor the transmission of command codes to a home entertainment center, what is needed is a system that functions to monitor remote control transmissions for the purpose of tracking the state of appliances. In this regard, remote controls commonly provide for the transmission of a sequence of command codes in response to activation of a macro key, such as described in U.S. Pat. No. 5,959,751. By way of example, a macro can be used to transmit a sequence of command codes to power on all appliances of a home entertainment center, to access pay-per-view events via a set-top box, etc. However, if a home appliance is already in a state that is intended to be controlled by a command in a macro command transmission (e.g., the macro is intended to turn on an appliance that is already in the "on" state), the receipt of such a command may place the appliance in an unintended state (e.g., the receipt of the "power" command may inadvertently cause the appliance to toggle to the "off" state).

It is also known in the art to maintain within the internal memory of a remote control a record of commands issued to appliances from that remote control for the purpose of attempting to predict the status of a controlled appliance. An example of such a remote control system is disclosed in U.S. Published Patent Application No. 2001/0045819 entitled "State-based Remote Control System." While such a remote control system may work in theory, it is seen that such a remote control system suffers the disadvantage that the potential use of multiple remote controls, etc. cannot be accounted for in making a status prediction that is derived from a record that is maintained within the internal memory of a single remote control.

From the foregoing, it will be appreciated that a need exists for an improved system and method that functions to monitor remote control transmissions for the purpose of preventing an appliance from being commanded to enter an unintended state.

SUMMARY

In accordance with this and other needs, a remote control transmission monitoring system is hereinafter described. Generally, the system monitors remote control transmissions for the purpose of updating state tables for one or more remotely controllable appliances. The state tables may then be queried for the purpose of determining the present state of an appliance whereby the transmission of a command that would place an appliance in an unintended state may be avoided.

A better understanding of the objects, advantages, features, properties and relationships of the subject system and method will be obtained from the following detailed description and accompanying drawings which set forth illustrative embodiments which are indicative of the various ways in which the principles of the system and method may be employed.

BRIEF DESCRIPTION OF THE DRAWINGS

For a better understanding of the system and method described hereinafter, reference may be had to preferred embodiments shown in the following drawings in which:

FIG. 4 illustrates an exemplary set of state tables for controllable appliances;

DETAILED DESCRIPTION

Figure 1:
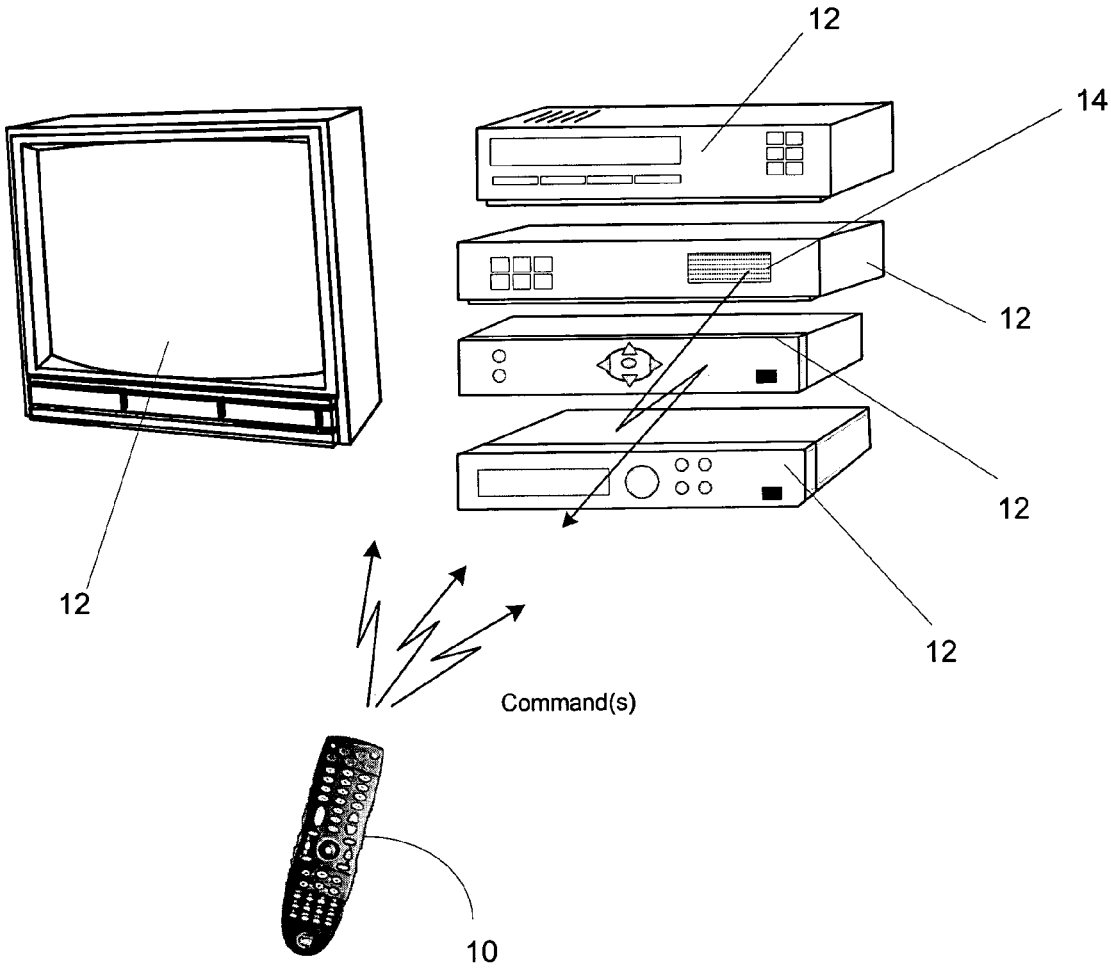
FIG. 1 illustrates an exemplary system employing a method for monitoring remote control transmissions.

With reference to the Figures, a system and method is described for monitoring remote control transmissions. To this end, the system generally includes one or more remote controls 10 each of which is adapted to transmit command codes to control the operation of one or more home appliances 12 as is illustrated in FIG. 1. By way of example only, the appliances 12 can include, but are not limited to, televisions, VCRs, DVRs, DVD players, cable converter boxes, amplifiers, CD players, game consoles, home lighting, drapery, fans, HVAC systems, thermostats, personal computers, etc. While the remote control 10 is described hereinafter in the context of a universal remote control, i.e., one that is modifiable to command appliances of different types of different manufactures, it is to be appreciated that the remote control 10 may also be a dedicated remote control, i.e., a remote control that is supplied by a manufacturer with an appliance that is preprogrammed to command that appliance. In certain other cases, the remote control 10 may also be a dedicated remote control (with respect to the type of appliance it was supplied with) and a universal remote control with respect to other appliance types (e.g., a remote control that has its TV mode preset to the Sony brand television with which it was supplied while being universal with respect to other modes such as a VCR mode).

Figure 2:
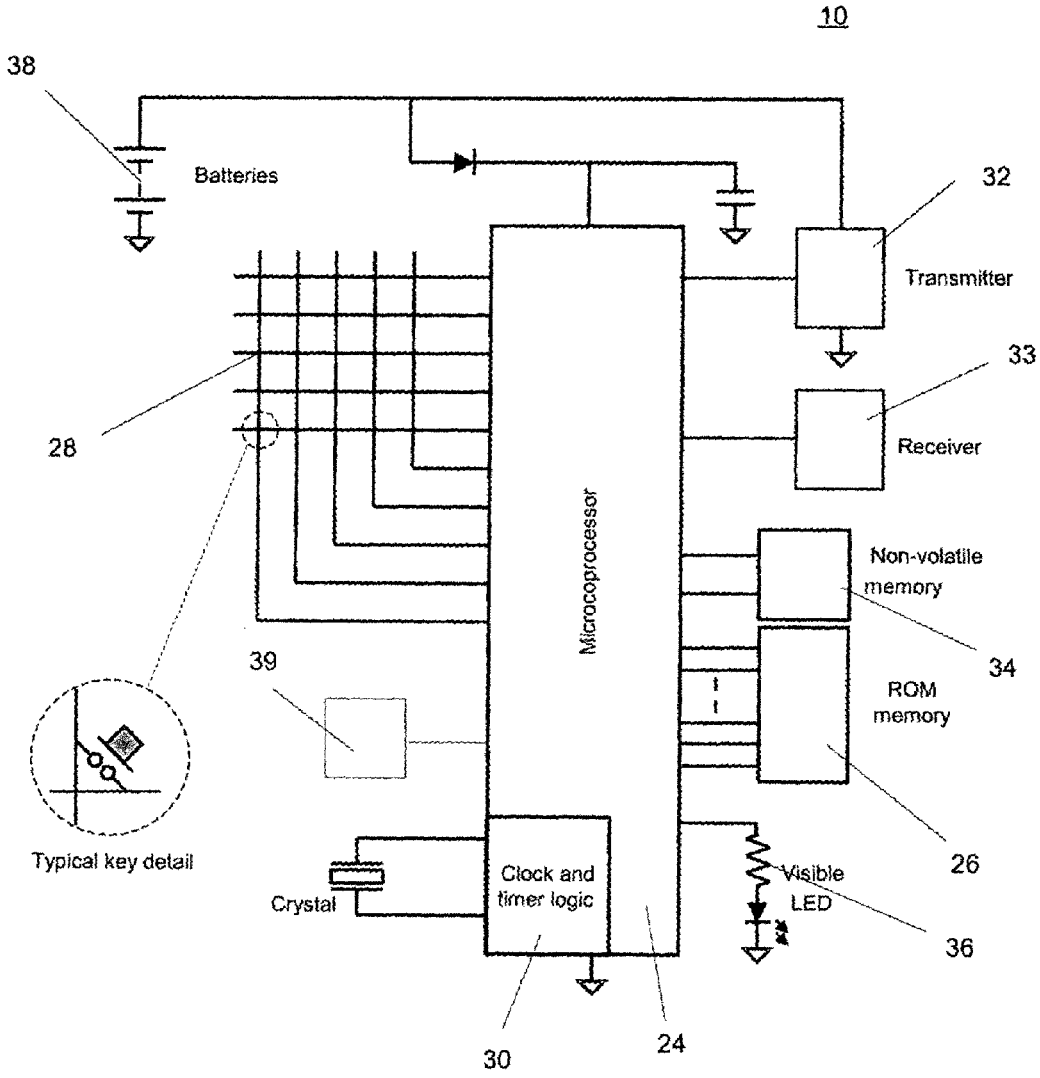
FIG. 2 illustrates a block diagram of components of an exemplary remote control.

For use in transmitting command codes to one or more of the appliances 12, the remote control 10 may include, as needed for a particular application, a processor 24 coupled to a ROM memory 26, a key matrix 28 (e.g., physical buttons, a touch screen display, or a combination thereof), an internal clock and timer 30, transmission circuit(s) 32, receiver circuit(s) 33 and/or transceiver circuit(s) (e.g., IR and/or RF), a non-volatile read/write memory 34, a means 36 to provide feedback to the user (e.g, LED, display, speaker, and/or the like), a power supply 38, and input means 39 (e.g., serial I/O port, wireless receiver, bar code scanner, etc.) as generally illustrated in FIG. 2. As will be understood by those of skill in the art, the ROM memory 26 may include executable instructions that are intended to be executed by the processor 24 to control the operation of the remote control 10. In this manner, the processor 24 may be programmed to control the various electronic components within the remote control 10, e.g., to monitor the power supply 38, to cause the transmission of signals, etc. The non-volatile read/write memory 34, for example an EEPROM, battery-backed up RAM, Smart Card, memory stick, or the like, may be provided to store setup data and parameters as necessary. While the memory 26 is illustrated and described as a ROM memory, memory 26 can also be comprised of any type of readable media, such as ROM, RAM, SRAM, FLASH, EEPROM, or the like. Preferably, the memory 26 is non-volatile or battery-backed such that data is not required to be reloaded after battery changes. In addition, the memories 26 and 34 may take the form of a chip, a hard disk, a magnetic disk, and/or an optical disk.

To identify home appliances by type and make (and sometimes model) such that the remote control device 10 is adapted to transmit recognizable command codes in the format appropriate for such identified appliances 12, data may be entered into the universal remote control device 10. Since methods for setting up a remote control to control the operation of specific home appliances are well-known, such methods need not be described in greater detail herein. Nevertheless, for additional information pertaining to remote control setup, the reader may turn to U.S. Pat. Nos. 4,959,810, 5,614,906, and 6,225,938. It will also be appreciated that the remote control 10 may be set up to control an appliance 12 by being taught the command codes needed to control such appliance as described in U.S. Pat. No. 4,623,887.

To cause the remote control 10 to perform an action, the remote control 10 is adapted to be responsive to events, such as a sensed user interaction with the key matrix 28, receipt of a transmission, etc. In response to an event appropriate instructions within the memory 26 may be executed. For example, when a command key is activated on the remote control 10, the remote control 10 may retrieve a command code corresponding to the activated command key from memory 26 and transmit the command code to a device in a format recognizable by the device. It will be appreciated that the instructions within the memory 26 can be used not only to cause the transmission of command codes and/or data to the appliances 12 but also to perform local operations. While not limiting, local operations that may be performed by the remote control 10 include displaying information/data, favorite channel setup, macro button setup, function key relocation, etc. Examples of local operations can be found in U.S. Pat. Nos. 5,481,256, 5,959,751, and 6,014,092. Additional examples of remote controls 10 may be found in commonly owned, U.S. Pat. No. 6,225,938 and U.S. Application Ser. Nos. 60/264,767, 09/905,423, 09/905,432, and 09/905,396.

In keeping with the subject system and method, the remote control 10 preferably includes programming such that activation of a macro key causes the transmission of a sequence of command codes that have been assigned to the macro key. In the case where macros are user programmable, the macro programming will also allow a user to assign one or more command codes to the macro key. By way of example only, the assignment of command codes to the macro key may be made by the user interacting with the keys of the remote control 10 in the manner described in U.S. Pat. Nos. 5,959,751 or 6,587,067. Alternatively, the remote control can be preprogrammed to transmit one or more command codes in response to activation of the macro key. Still further, one or more command codes may be assigned to the macro key by means of being downloaded to the remote control, for example after an interactive session with a network site that maintains a database of command codes.

Figure 3:
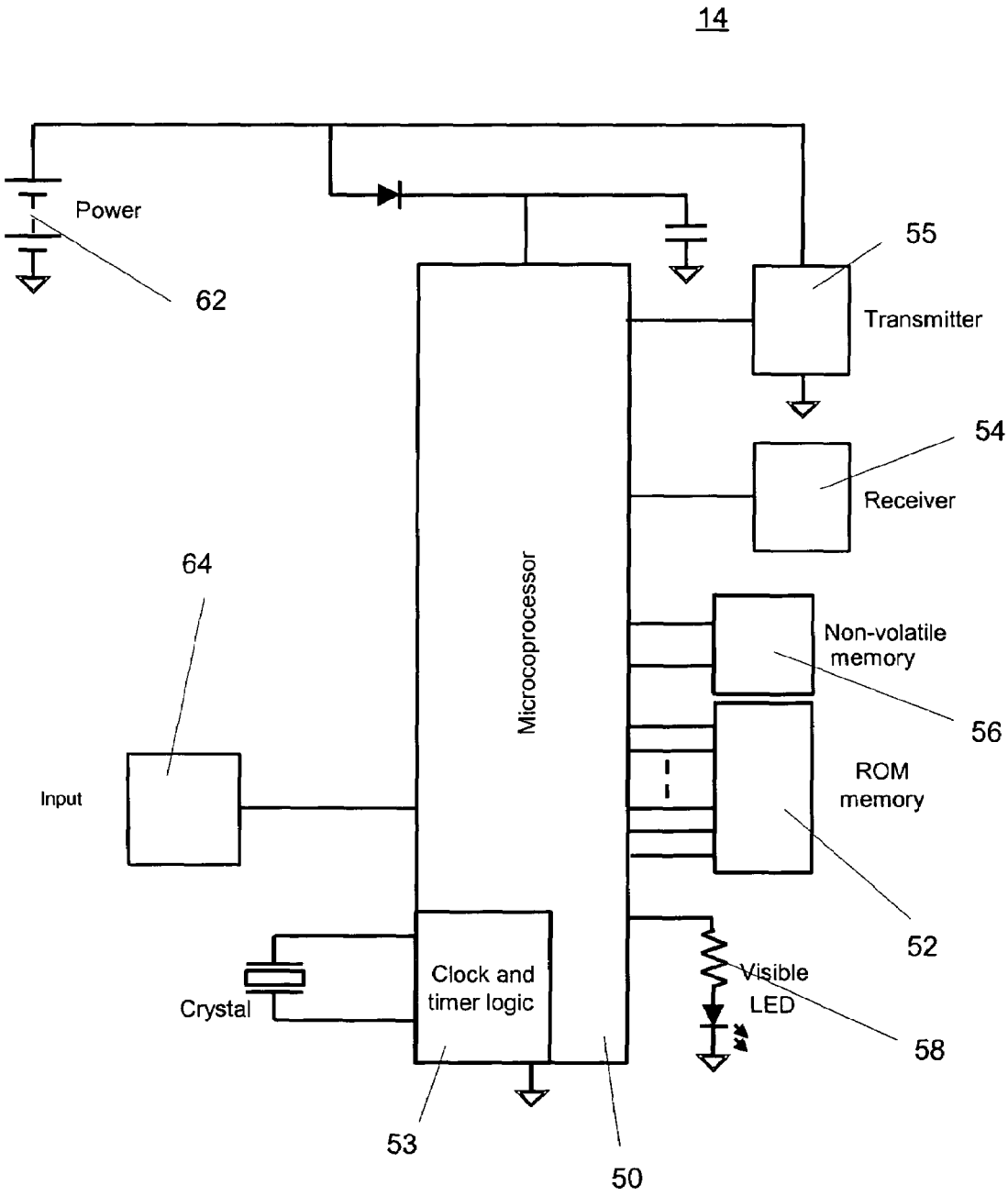
FIG. 3 illustrates a block diagram of components of an exemplary command receiver.

For use in monitoring for the transmission of command codes from a remote control 10 to one or more of the appliances 12 the subject system and method includes a command receiver 14. The command receiver 14 may be a device separate and apart from the appliances 12 or may be integrated into one or more of the appliances 12 as is illustrated in FIG. 1. In either case, the command receiver 14 may include, as needed for a particular application, a processor 50 coupled to a ROM memory 52, an internal clock and timer 53, receiver circuit(s) 54, transmission circuit(s) 55 and/or transceiver circuit(s) (e.g., IR and/or RF), a non-volatile read/write memory 56, a means 58 to provide feedback to the user (e.g., LED, display, speaker, and/or the like), a power supply 62, and input means 64, (e.g., serial I/O port, wireless receiver, bar code scanner, etc.), as is generally illustrated in FIG. 3. The ROM memory 52 includes executable instructions that are intended to be executed by the processor 50 to control the operation of the command receiver 14. In this manner, the processor 50 may be programmed to control the various electronic components within the command receiver 14, e.g., to monitor the power supply 62, to cause the transmission of signals, to provide audio or visual prompts to a user, etc. The non-volatile read/write memory 56, for example an EEPROM, battery-backed up RAM, Smart Card, memory stick, or the like, is provided to store setup data and parameters as necessary. While the memory 52 is illustrated and described as a ROM memory, memory 52 can also be comprised of any type of readable media, such as ROM, RAM, SRAM, FLASH, EEPROM, or the like. Preferably, the memory 56 is non-volatile or battery-backed such that data is not required to be reloaded after battery changes. In addition, the memories 52 and 56 may take the form of a chip, a hard disk, a magnetic disk, and/or an optical disk. It will also be appreciated that in cases where command receiver capability is integrated into an appliance, some or all of the functional elements described above in conjunction with FIG. 3 may be combined with similar elements already present in the appliance for other purposes.

Further maintained within the non-volatile read/write memory 56 is a state table which stores parameters representative of one or more states of one or more appliances. More specifically, as illustrated in FIG. 4, the state table attempts to reflect the state of an appliance by storing parameters that are indicative of the transmission of commands to an appliance. For example, if the appliance is responsive to a "power" toggle command, the "power" field (PF) for that appliance may toggle between a "1," being used to represent that the appliance power should be on, and "0," being used to represent that the appliance power should be off. The state parameter may be simple Boolean value for states that are either "on" or "off" or may be binary values, for example, representative of a number of times a command has been transmitted to an appliance. In the latter case, the command receiver 14 may also be programmed to recognize if an appliance is to change states once a predetermined number of command transmissions to command a state have been achieved, e.g., a VCR or PVR resumes a "playing" state after the receipt of a third "FF" command, the first received "FF" command causing the appliance to fast forward at 2× speed and the second received "FF" command causing the appliance to fast forward at 4× speed.

It will be appreciated that the abovementioned state table may be maintained either in part or entirely at a location physically separate from the receiver 14 (such as, for example, a personal computer located elsewhere in the home) and need only be accessible to the receiver 14 for state data storage and retrieval operations, as will be described in more detail later.

It will also be appreciated that, in a system that attempts to track state by means of remote control transmissions, a user would be instructed to avoid manually changing the state of an appliance. In such a case, however, the command receiver 14 may be provided with a means to set the parameters within the state table to a known value, i.e., a reset state, to thereby resynchronize the state table to the actual state of the appliance. For example, the user may be instructed fully reduce the volume, etc. (either manually or via a remote control transmission), place the appliance in an "off" state, and then issue a reset command to the command receiver 14 (either manually or via a remote control transmission) to cause the state table for that appliance to reflect the known, "off," no-volume condition.

It is to be further appreciated that the state table need not be used to reflect all possible states of an appliance. In some circumstances, it may only be desirable to track states that may change should the appliance receive a command to enter a state the appliance is already within, e.g. the transmission of a "power" toggle command for the purpose of powering on an appliance that is already on, the transmission of a "FF" command to an appliance already in "FF" mode and having multiple "FF" speeds, etc. By way of further example, if an appliance is responsive to discrete power commands (as opposed to a "power toggle" command that causes the appliance to toggle between a "power on" state and a "power off" state) it may not be necessary to track the power state for the appliance, i.e., the state of the appliance would not be inadvertently changed as a result of receiving a discrete "power on" command in the case where the appliance is already powered on.

To create a state table entry for an appliance to be controlled, the appliance to be monitored is preferably identified to the command receiver 14 using one or more of the methods described hereinafter. Once the appliance is identified to the command receiver 14, the particular states to monitor may be preconfigured or user programmable without limitation. For example, once an appliance is identified to the command receiver 14, the command receiver 14 will be able to recognize command transmissions from a remote control 10 intended for that appliance and, as such, will be aware of the functional states of the appliance that are controllable by a remote control 10.

Figure 5:
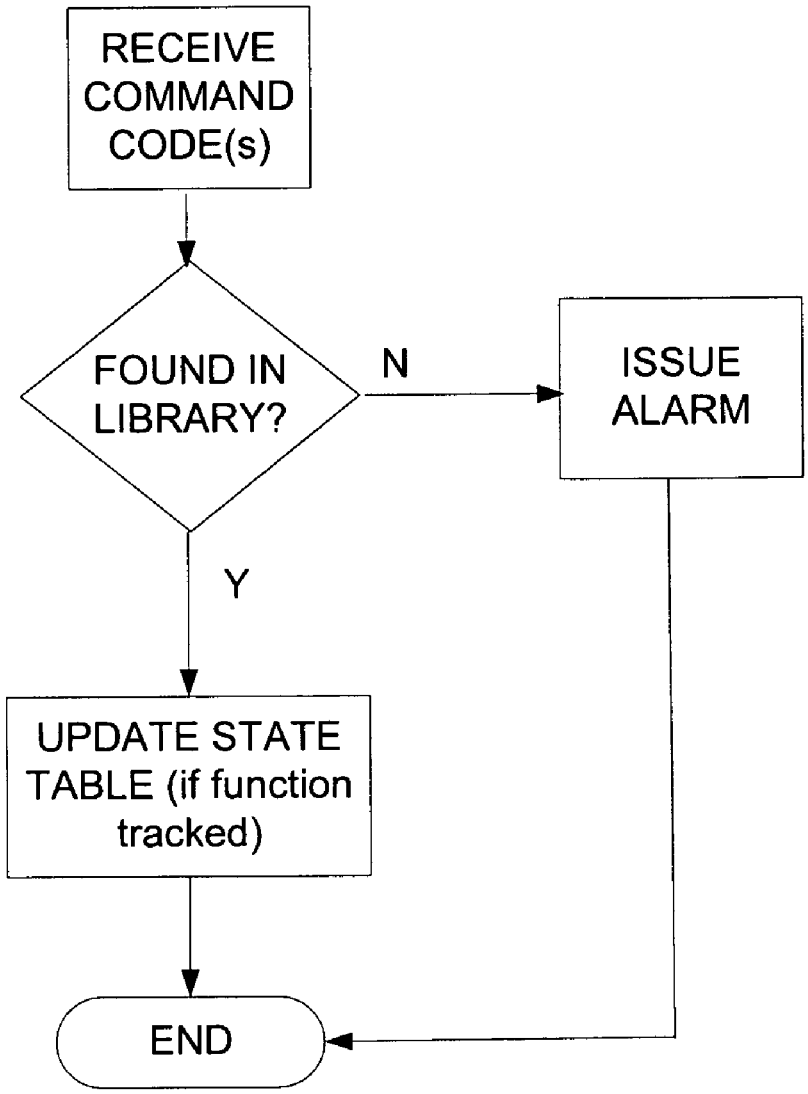
FIG. 5 illustrates a flow chart diagram of exemplary steps for use in monitoring for the successful transmission of a remote control command code.

When monitoring for the transmission of one or more commands to an appliance, especially in the case of IR transmissions, numerous activities may interrupt the transmission of command codes from a remote control 10 to the appliances 12. For example, a user may move the remote control 10 such that an IR signal transmission is misdirected away from the appliances, another person may walk in front of the remote control 10 and inadvertently block an IR signal transmission, etc. Thus, as further illustrated in FIG. 5, the programming within the command receiver 14 preferably includes instructions for monitoring for the transmission of command codes by the remote control 10 and for determining, especially in the case of a macro where a plurality of commands are to be transmitted in sequence, if all of the command codes in the sequence were received by the command receiver 14.

For determining if a command code was properly received at the command receiver 14, a command code received by the receiver circuit(s) 54 may be compared against a library of command codes stored in the memory 52 or 56 of the command receiver 14. If command is properly received and recognized, the state table for the intended target appliance(s) may be updated to reflect the received command transmission. If the command is not properly received and recognized, an audible or visual alarm may be issued.

The library of command codes which are used in the step of comparing may be stored in the memory 52 or 56 at the time of manufacture and/or be downloaded into the command receiver which, for example, allows the library of command codes to be upgradeable. Downloading may be performed by means of wired or wireless connection and may include downloading the command codes via a network connection as described in U.S. Pat. No. 4,959,810, downloading the command codes via learning circuitry as described in U.S. Pat. No. 4,623,887, or the like.

In the case where the command receiver 14 is to evaluate the reception of a macro, i.e., a series of the command codes where the sequence may (or may not) be important to the operation of the intended target appliances, the command receiver 14 may additionally be programmed to recognize the sequence of command codes. To this end, the sequence of command codes that comprise a macro may be taught to the command receiver 14 in same manner as described in U.S. Pat. No. 4,623,887. More specifically, the command receiver 14 may be placed into a macro definition mode, the command codes that will comprise the macro may be transmitted to the command receiver 14 (for example, by the remote control 10), and the command receiver 14 may be caused to exit the macro definition mode as a means to inform the command receiver 14 that the entirety of the command sequence has been transmitted. It will be appreciated that the sequence of command codes that will comprise a macro may also be programmed into the command receiver 14 by interacting with a keypad (not illustrated) of the command receiver 14 in the same manner that would be used to program the remote control 10 to transmit the macro. Still further, the sequence of command codes that will comprise a macro may be downloaded into the command receiver 14 via a network connection (for example if the remote control macro is set up via interaction with a Web site—the same macro can be downloaded into the command receiver 14), by means of being read from a barcode, by being read from a smart card, etc.

Figure 7:
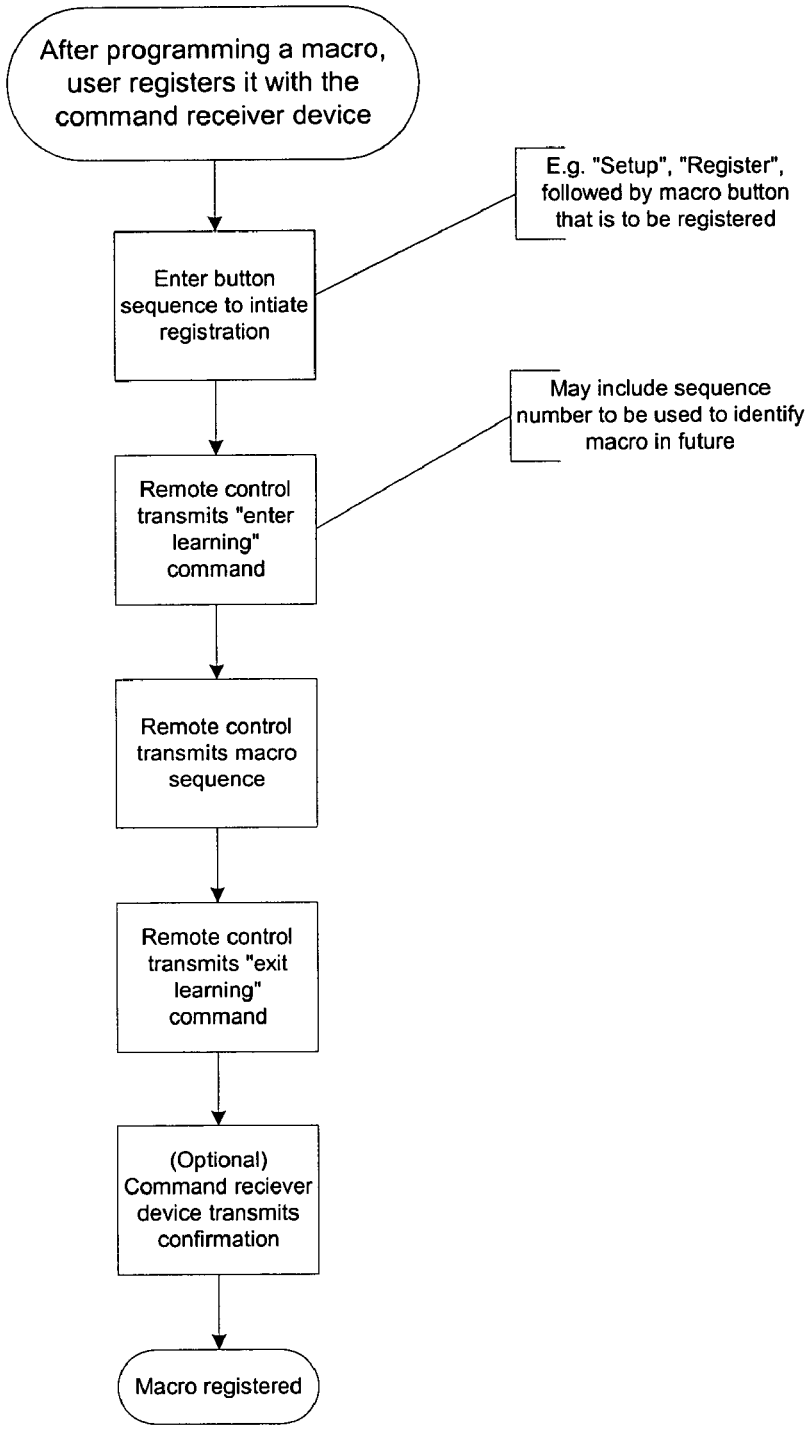
FIG. 7 illustrates a flow chart diagram of exemplary steps for registering a macro command code sequence with a command receiver.

By way of further example, the remote control 10 and command receiver 14 may be adapted to cooperate to facilitate the learning of command codes by the command receiver 14. To this end, with reference to FIG. 7, the remote control 10 may be adapted to respond to a user input that functions to signify a desire to request registration of a macro with the command receiver 14. In response to this user input, the remote control 10 may transmit a predefined "enter learning state" command to the command receiver 14 (e.g., using a standard infrared format recognizable by the command receiver 14) followed by the macro command code sequence to be taught to the command receiver 14. The end of the macro command code sequence may be signified by the remote control 10 transmitting an "exit learning state" command to the command receiver 14. It will be appreciated that the command receiver 14 should respond to the "exit learning state" command so as to stop the recording of transmissions from the remote control 10.

Once the command codes that are to be monitored by the command receiver 14 have been stored and made accessible to the command receiver 14, the command receiver 14 is capable of comparing received command codes to determine if one or more received command codes has a counterpart within the library command codes accessible to the command receiver 14. The command receiver 14 may be programmed to always monitor the transmission of commands or may be programmed to commence the monitoring of command codes in response to a receipt of a "start monitoring" command code, for example, if selective monitoring is desired. The "start monitoring" command code may, for example, be transmitted from the remote control 10 as a prefix to a command code sequence that is transmitted from the remote control 10 in response to activation of a macro key. In this manner, if a counterpart to the received command code is determined to be missing from the library of command codes, it may be assumed that the received command code was corrupted during transmission. In such a case, the command receiver 14 may issue an alarm, visible or audible, to inform the user that they should attempt to resend the command code.

In the case where the command receiver 14 receives a series of commands transmitted as a macro transmission from the remote control 10, the sequence of command codes received by the receiver circuit(s) 54 of the command receiver 14 may also be compared against one or more stored sequences of command codes made accessible to the command receiver 14. In this manner, if a sequence of command codes received by the receiver circuit(s) 54 of the command receiver 14 fails to be found in the stored sequence(s) of command codes made accessible to the command receiver 14, e.g., one or more command codes are missing from the received transmission, the command receiver 14 may issue an alarm to inform the user that they should attempt to resend the macro command sequence.

Figure 6:
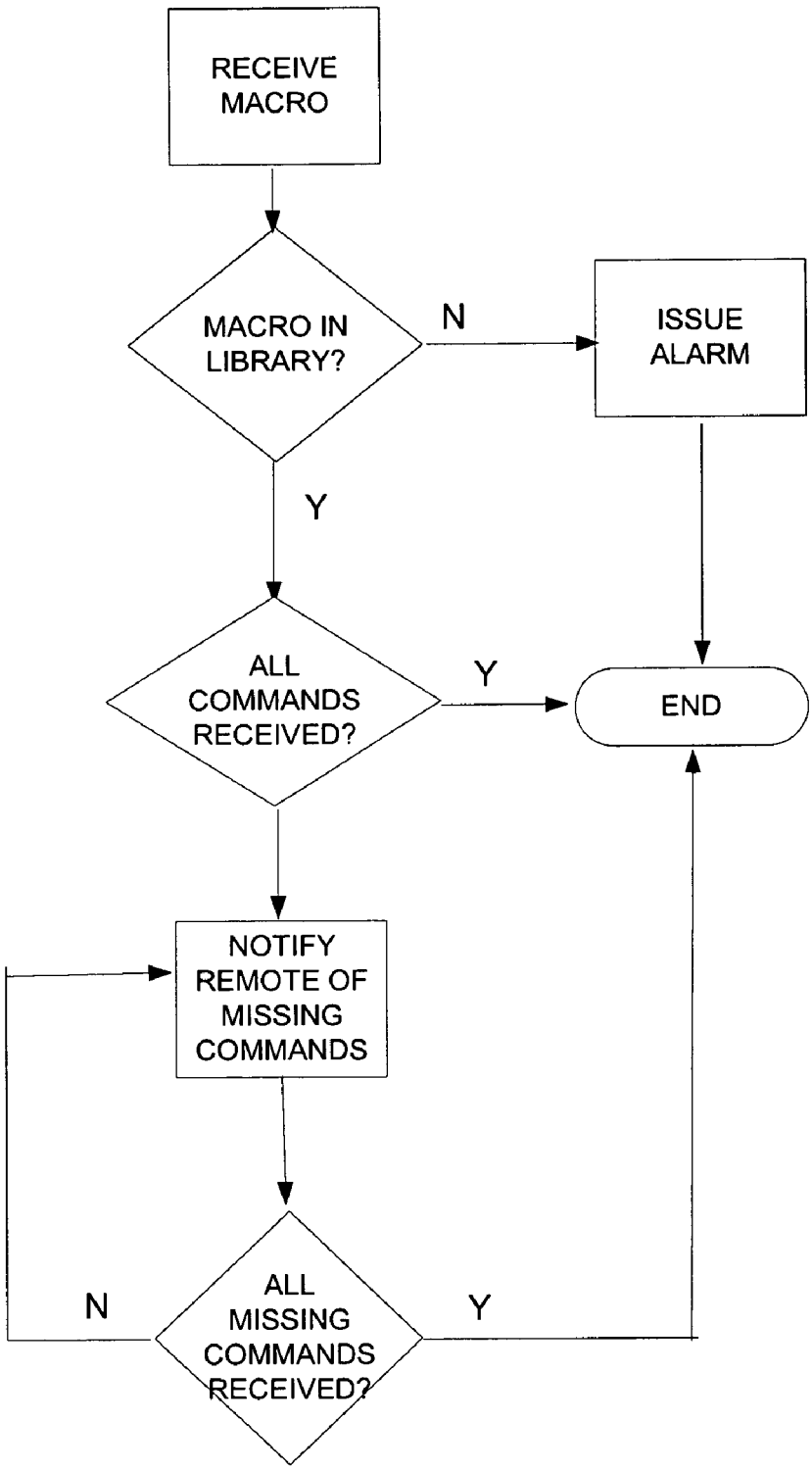
FIG. 6 illustrates a flow chart diagram of exemplary steps for use in monitoring for the successful transmission of a sequence of remote control command codes.

It may also be desirable to have the command receiver 14 notify the remote control 10 as to which command codes from a macro command code sequence were not properly received by the command receiver 14 to thereby allow for the retransmission of just those command codes. To this end, as illustrated in FIG. 6, the command receiver 14 may compare a received sequence of command codes against the macro command code sequences stored in memory, discern which macro stored in its memory is most likely to be the one that was intended to be transmitted by the remote control 10 (if more than one macro has been programmed into the command receiver 14), discern which command codes from that stored macro were not received, and issue a transmission (e.g., an event) to the remote control 10 that notifies the remote control 10 which commands were discerned to be missing from the intended macro transmission.

The transmission from the command receiver 14 to the remote control 10 may include data indicative of the missing command codes, e.g., a pointer into the memory of the remote control 10, or the missing command codes themselves. When the transmission includes the missing command codes, the command codes may be temporarily stored in the memory of the remote control 10 for easy retransmission back to the appliances 12. In either instance, it is preferred that the user be provided with an indication, such as a visible or audio alarm, that the remote control 10 has received a transmission from the command receiver 14 and is in a state for retransmitting command codes to the appliances 12, either using the received data or received command codes. The retransmission from the remote control 10 may be initiated by using a key that has been provided for that purpose, by activating the macro key again (in which case the remote control 10 would temporarily override the original programming of that macro key), etc. The command receiver 14 may additionally be programmed to look for the successful retransmission of those command codes that were previously determined to be missing. An appropriate timeout may be utilized in such a case to prevent the command receiver from becoming locked in a state where it is looking for the specific transmission of such command codes.

The system may also be configured such that the command receiver 14 is programmed to monitor the transmission of each command code as a sequence of command codes is received from the remote control 10. In this case, the command receiver 14 may confirm and acknowledge the receipt of that command code with the remote control 10. The remote control 10 may then wait for the acknowledgement before issuing the next command code in the sequence. If an acknowledgement is not received within a predetermined time, the remote control 10 may cause the command code from the sequence to be retransmitted.

In certain instances, it may also be desirable to provide labels to the macro transmissions to facilitate recognition of sequences of command codes by the command receiver 14. This would be particularly useful in the case where the command code sequence of one macro might be include as a subset of the command code sequence of another macro. To this end, the command receiver 14 may be taught a macro label by, for example, having the "enter learning state" command include a designator, e.g. a number, which has been assigned to the macro command code sequence to be learned by the command receiver 14. The designator assigned to a macro command sequence and included in the "enter learning state" command may be user programmable or may be, for example, pre-programmed by being representative of a key of the remote control 10 to which the macro command code sequence has been assigned. The command receiver 14 may then be informed of which command code sequence it is expected to receive by, for example, including the macro designator as part of a "start monitoring" command code transmitted from the remote control 10.

It may also be desired, in the case where the command receiver 14 is integrated within an appliance 12, to perform further steps whereby the command receiver 14 also functions to discern if all of the command codes of a macro intended to be transmitted from the remote control 10 were intended for the appliance 12 having the command receiver 14. If all of the command codes of the macro were intended for the appliance 12 having the command receiver 14, the appliance 12 may include a further feature that prohibits the appliance 12 from acting upon the received command codes until such time as the command receiver 14 discerns that all of the command codes in a macro were correctly and completely received. Alternatively, the appliance 12 may be programmed to simply perform all of the operations indicated by the command codes in a macro despite the fact that certain commands were not received, for example if a predetermined number of commands from a programmed macro are received by the command receiver 14.

Still further, the appliance 12 may consult a locally maintained state table or a general state table maintained by command receiver 14, or a remote device such as a personal computer, to discern if the appliance is already in a state desired by the macro and inhibit execution of a command that may effect that state, e.g., inhibit the execution of a "power toggle" command intended to turn the appliance on if the appliance is already in the "on" state. In this case, the appliance 12 may be preprogrammed to assume that the transmission of a "power toggle" command as part of a macro sequence is intended to turn an appliance "on." The appliance 12 may also be manually programmable whereby a user can affirmatively inform the appliance as to which states the appliance is to achieve when a macro is executed, for example, using a menu or the like conventional programming tool.

Figure 8:
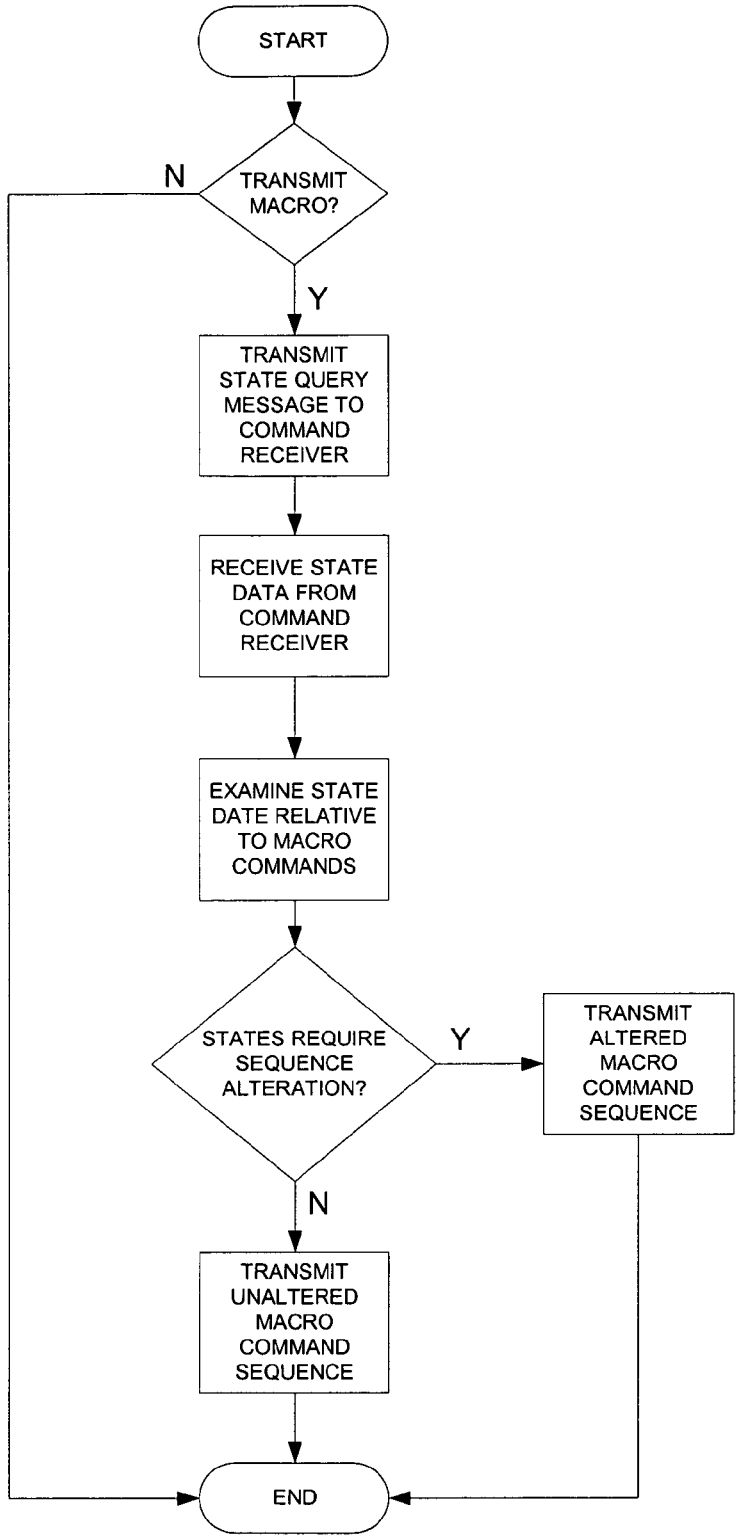
FIG. 8 illustrates a flow chart diagram of exemplary steps for querying state information for use in transmitting a macro command sequence.

With respect to macro command transmissions, the system may also be adapted to query the state table before actually transmitting the commands associated with the macro. For example, as illustrated in FIG. 8, in response to activation of a macro command key, i.e., a key that is to be actuated to commence transmission of a macro command sequence, the remote control 10 may query the command receiver 14 to gather data indicative of the present state of the appliances. In this regard, the remote control 10 may make a general request and upload data for all of the appliances being monitored by the command receiver 14 or may specify in the query message the appliances of interest, i.e., by examining the intended target appliances of the commands within the macro command sequence. Still further, the remote control 10 may examine the macro command sequence to discern the functions to be commanded and then issue a query with respect to only those functions of interest. In this latter case, the query may be further limited to only those functions that have the possibility of being acted upon to place an appliance in an unintended state, e.g., when the macro is intended to turn an appliance "on" and the appliance is known to be responsive to power toggle commands, which scenario is described in commonly assigned U.S. application Ser. No. 10/087,078 which is incorporated herein by reference in its entirety. In response to the query message, the command receiver 14 will examine its state table(s) and return the requested data to the remote control 10.

The query/response communications between the remote control 10 and the command receiver 14 may be performed using an IR protocol such as XMP (described in co-pending U.S. patent application Ser. No. 10/431,930) an RF protocol such as Bluetooth or 802.11, or any other suitable wireless transmission method. All that is required is that the command receiver 14 be able to decipher a received query command and that the remote control 10 be able to decipher a received query response. Once the remote control 10 receives the query response, the remote control 10 may intelligently utilize the state information to discern whether a command within a macro command sequence is to be transmitted. For example, if the sequence indicates that an appliance is to be turned off and the appliance is already indicated to be in an off state, the remote control 10 may omit the transmission of the appliance power command from the sequence. In this regard, the remote control 10 may be preprogrammed to assume that certain commands that are capable of commanding an appliance to enter into more than one state when received multiple time, e.g., a power toggle command, are intended to place the appliance in a specific state as part of the macro. Alternatively, a user may be provided with an opportunity to program the remote control 10 (using a conventional graphical user interface) or have the remote control 10 programmed (for example as part of a macro command downloading process) to indicate the exact state that an appliance is to enter in response to the receipt of a command in a macro sequence, e.g., that the appliance is to turn off when the macro is executed. In this latter case, the intended state of an appliance information would be stored within the memory of the remote control and be accessible as being associated with the macro.

The state table of the command receiver 14 may also be queried to show a graphical representation of a state of a device (in cases where a remote control 10 has a graphical user interface display or is otherwise alterable to display appliance state information—for example, in the case of a remote control having an EL display). In this case, the command receiver 14 may be polled periodically. Alternatively, the command receiver 14 may issue a broadcast message to the remote control(s) 10 including data reflective of one or more state table(s) anytime the command receiver 14 causes a state table entry to be updated. The broadcast message may include data with respect to all of the entries of all of the state tables, data with respect to only the appliance whose state has changed, or data with respect to only the changed state. The received state information would again be stored within the remote control 10 and be accessed as needed to display state information to the user.

For performing some of these discussed functions, it will be appreciated by those skilled in the art that the command receiver 14 may not be required to completely decode and understand command codes that it receives. Rather, the command receiver 14 may only need to store a representation of a command transmission that would be sufficient to identify if that same transmission has been sent by the remote control 10. Accordingly, differences in receiver bandwidth, response time, sampling interval, etc., between the command receiver hardware 54 and that of the other appliances for which signals are destined may not be critical provided the detected and stored signal data is consistent and repeatable, i.e., the stored representation need not be an exact representation of the transmitted command code sequence.

It will be additionally understood and appreciated by those skilled in the art that the remote control 10 of the present invention may be any portable control device (including but not limited to IR and/or RF based remotes, portable phones, wireless capable PDAs, etc) capable of transmitting and/or receiving command codes remotely to and from the command receiver 14. Likewise, the command receiver 14 of the present invention may be any home control device (including but not limited to STB's, media center PC's, home automation systems, etc) capable of receiving signals representing command codes from the portable control device, determining whether the complete set of command codes was received, and effectuating state changes in one or more appliances (either directly, or through further operation and interaction with the portable control device or other control devices).

Figure 9:
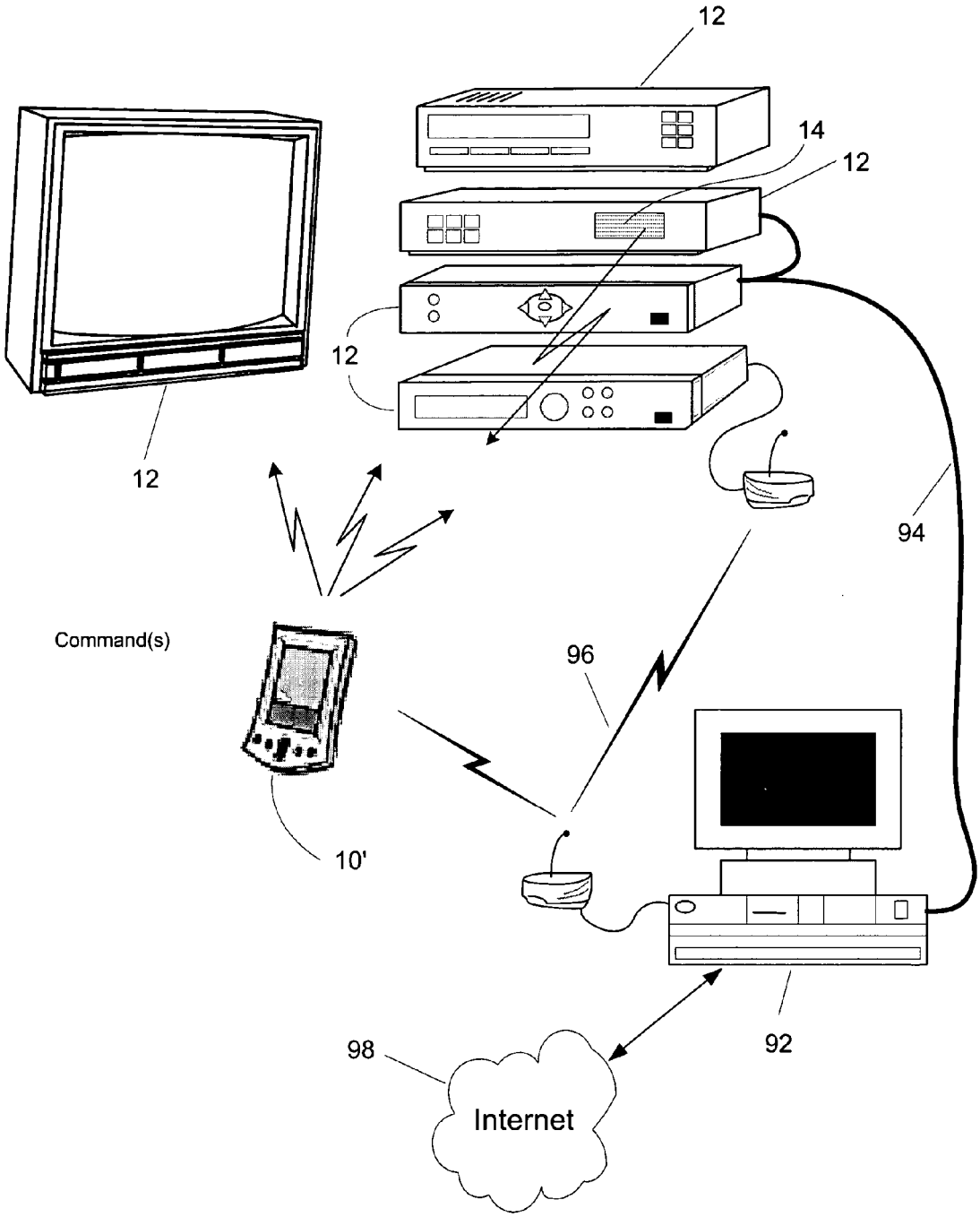
FIG. 9 illustrates a further exemplary system employing a method for monitoring remote control transmission.

While described in the context of monitoring command transmissions using a command receiver 14 associated with a home appliance, with reference to FIG. 9 it will also be appreciated that a home control device, such as a personal computer 92, may also include instructions for performing, for example, all or part of the processes described as being performed by the command receiver 14. To this end, the home control device 92 may comprise machine-readable instructions loaded in an accessible memory such as a hard disk drive or other non-volatile memory. The command receiver 14 may be incorporated into the home control device 92 or may be located separately, communicating with the home control device via a wired (as illustrated in FIG. 9) or wireless link. The machine-readable instructions of the home control device 92 may be adapted to perform pre-programmed logic processing on an incoming command code set(s) such that an accurate determination of the completeness of the received command codes may be made without pre-configuring, learning, or otherwise notifying the home control device of the incoming command codes sets prior to receiving the command codes. The software to implement such a system is well within the routine skill of a programmer, and may include for instance, reference to a comparative database of command codes types, frequently used or desirable command code sets, determination of a particular command code scheme (such as a particular type of IR command encoding scheme), etc. It will also be appreciated that a combination of learned, programmed, or pre-loaded command codes sets used in conjunction with software based logic operations in the home control device may serve to further enhance the accuracy of determined missing command codes, while not necessarily requiring a user to program or teach every desired command code set to the home control device.

The home control device may also be connected to a network (such as a wired LAN or Firewire link 94, a wireless LAN 96, a WAN, or the Internet 98) such that it may receive close range command codes (such as via an IR or RF based remote control 10') and/or long range command codes (such as from a remote user sending command codes from a portable phone, wireless enabled PDA, etc via the Internet), in each case the home control device 92 being able to determine whether a complete set of command codes was received, and initiate a corrective measure via a signal back to the user and/or portable control device, or directly to the appliance(s) affected by the missing or incomplete command codes. By way of example, a remote user may send command codes (for instance representing commands to turn on the house lights and the home stereo) from a user interface on a wireless enabled PDA via the Internet to the home control device. The command codes may be any digital representation of the actual command codes to be sent the desired appliances, including a reference name or number indicating to the home control device the desired command codes. The home control device may then determine whether all command codes of the command code set were received properly (using the system and method as described above) and generate a signal to correct any missing or incomplete command codes. In cases where the home control device determines (generally through application of a software program or logic) that it cannot accurately recreate or determine the missing or incomplete command codes from a command code set, it may generate a signal to notify the portable control device and/or user to resend the command codes (either the entire command code set, selected missing command codes, or command codes for the portable control device to repeat back directly to one or more appliances). The home control device may also consult the state table to prevent an appliance from being placed into an unintended state by a command received from a remote device, such as a PDA. In each of these cases, the home control device may serve to relay desired command codes directly to various desired appliances to effectuate the desired functionality, or may relay one or more signals to a secondary signal relay/generation device (such as an IR repeater, RF wireless access point, etc) to effectuate the desired appliance functionality. Such a system may also be used to relay state information to a remote device, such as a PDA, whereby the user may discern the present state of an appliance, i.e., have the children turned on the TV, did the user forget to turn off an appliance, etc. The remote device may again be used to initiate the transmission of a command to an appliance to perform an action, either automatically or manually, in the case where the desired state of an appliance does not match that reported to the remote device.

In cases where consumer electronic appliances are adapted to communicate with one another and/or controlling devices (using, for example, a home network 94 or 96 and/or data exchange methods such as proposed by HAVi or UPnP) the home control device 92 may additionally communicate directly with such appliances in order to determine the current status of various states. As before, the status of various states of various appliances can be returned to the remote control 10' for consideration during the command transmission process.

While various concepts have been described in detail, it will be appreciated by those skilled in the art that various modifications and alternatives to those concepts could be developed in light of the overall teachings of the disclosure. For example, while described in the context of functional modules and illustrated using block diagram format, it is to be understood that, unless otherwise stated to the contrary, one or more of the described functions and/or features may be integrated in a single physical device and/or a software module in a software product, or one or more functions and/or features may be implemented in separate physical devices or software modules. It will also be appreciated that a detailed discussion of the actual implementation of each module is not necessary for an enabling understanding of the invention. Rather, the actual implementation of such modules would be well within the routine skill of a programmer and system engineer, given the disclosure herein of the system attributes, functionality, and inter-relationship of the various functional modules in the system. Therefore, a person skilled in the art, applying ordinary skill, will be able to practice the invention set forth in the claims without undue experimentation. It will be additionally appreciated that the particular concepts disclosed are meant to be illustrative only and not limiting as to the scope of the invention which is to be given the full breadth of the appended claims and any equivalents thereof.

All documents cited within this application for patent are hereby incorporated by reference in their entirety.

What is claimed is:

1. A method of monitoring remote control transmissions, comprising:

identifying to a recipient device a plurality of intended target appliances;

receiving at the recipient device a transmission from the remote control;

determining at the recipient device if the transmission from the remote control is intended to command an operation of one of the plurality of intended target appliances; and when the transmission from the remote control is determined to be intended to command an operation of one of the plurality of intended target appliances, comparing the transmission from the remote control against a plurality of commands maintained within the recipient device to update data maintained within the recipient device such that the updated data reflects a state of the one of the plurality of intended target appliances which will result from the one of the plurality of intended target appliances performing the operation.

2. The method as recited in claim 1, wherein the data is maintained within a state table.

3. The method as recited in claim 1, comprising updating the data maintained within the recipient device only in cases where the transmission from the remote control is intended to command a toggled operation of the one of the plurality of intended target appliances.

4. The method as recited in claim 1, comprising placing the data into a known state upon the recipient device receiving a reset command.

5. The method as recited in claim 4, wherein the reset command is received via the remote control.

6. The method as recited in claim 4, wherein the reset command is received via manual activation of a reset button on the recipient device.

7. The method as recited in claim 1, wherein determining if the transmission from the remote control is intended to command an operation of the one of the plurality of intended target appliances comprises comparing the transmission from the remote control against the plurality of commands maintained within the recipient device.

8. The method as recited in claim 7, wherein identifying to a recipient device a plurality of intended target appliances causes the plurality of commands to be selected from a library of command code sets.

9. The method as recited in claim 8, wherein the library of command code sets is locally stored on the recipient device.

10. The method as recited in claim 8, wherein the library of command code sets is stored remotely from the recipient device and the selected plurality of commands are downloaded into the recipient device.

11. The method as recited in claim 1, wherein at least one of the commands in the plurality of commands is learned from the remote control.

12. A method of monitoring remote control transmissions, comprising:

identifying to a recipient device a plurality of intended target appliances;

receiving at the recipient device a transmission from the remote control;

determining at the recipient device if the transmission from the remote control is intended to command an operation of one of the plurality of intended target appliances, and when the transmission from the remote control is determined to be intended to command an operation of one of the plurality of intended target appliances, using the transmission to update data maintained within the recipient device such that the data reflects a state of the one of the plurality of intended target appliances which will result from the one of the plurality of intended target appliances performing the operation;

transmitting from the recipient device to the remote control at least a portion of the maintained data; and using the transmitted data within the remote control to determine if a transmission of a sequence of macro commands requires alteration given the state of the intended target appliance as indicated by the data.

13. The method as recited in claim 12, comprising updating the data maintained within the recipient device only in cases where the transmission from the remote control is intended to command a toggled operation of the one of the plurality of intended target appliances.

14. The method as recited in claim 12, comprising placing the data into a known state upon the recipient device receiving a reset command.

15. The method as recited in claim 14, wherein the reset command is received via the remote control.

16. The method as recited in claim 14, wherein the reset command is received via manual activation of a rest button on the recipient device.

17. The method as recited in claim 12, wherein determining if the transmission from the remote control is intended to command an operation of the one of the plurality of intended target appliances comprises comparing a command received from the remote control against a plurality of commands maintained within the recipient device.

18. The method as recited in claim 17, comprising identifying the plurality of intended target appliances to the recipient device to cause the plurality of commands to be selected from a library of command code sets.

19. The method as recited in claim 18, wherein the library of command code sets is locally stored on the recipient device.

20. The method as recited in claim 18, wherein the library of command code sets is stored remotely from the recipient device and the selected plurality of commands are downloaded into the recipient device.

21. The method as recited in claim 17, wherein at least one of the plurality of commands is learned from the remote control.

22. The method as recited in claim 12, comprising using the data received from the recipient device to display via the remote control a state of the one of the plurality of intended target appliances.

23. The method as recited in claim 12, comprising accepting input into the remote control that reflects an intended state for the one of the plurality of intended target appliances in response to the remote control transmitting the macro command sequence.

24. The method as recited in claim 23, comprising using the received data within the remote control to omit from the macro command sequence those commands that would cause the one of the plurality of intended target appliances to be placed into a state other than the intended state.

25. The method as recited in claim 12, comprising transmitting from the recipient device to the remote control all maintained data.

26. The method as recited in claim 12, wherein the recipient device transmits to the remote control at least a portion of the maintained data in response to a query message received from the remote control.

27. A method of updating a data representative of a current state of an intended target appliance, comprising:

receiving a transmission from a remote control; and comparing the transmission from the remote control to a plurality of commands to determine if the transmission from the remote control is one for commanding an operation of the intended target appliance and to update the data to represent the current state of the intended target appliance which will result from the intended target appliance performing the operation commanded.

28. The method as recited in claim 27, comprising supplementing the data with information obtained directly from the intended target appliance.

29. The method as recited in claim 27, wherein the data is maintained within a state table.

30. The method as recited in claim 27, comprising transmitting the data to a requesting remote control.

31. The method as recited in claim 27, comprising transmitting the data to a requesting personal computer.

32. The method as recited in claim 27, comprising transmitting the data to a remote device via an Internet connection.

33. The method as recited in claim 27, wherein the data is maintained locally within a device which receives the transmission.

34. The method as recited in claim 27, wherein the data is maintain remotely from a device which receives the transmission.

35. For use in a transmission monitoring device, a readable media having instructions for monitoring remote control transmissions, the instructions performing steps comprising:

receiving a transmission from a remote control; and comparing the transmission from the remote control to a plurality of commands to determine if the transmission from the remote control is intended to command an operation of an intended target appliance and to update data whereby the updated data reflects a state of the intended target appliance which will result from the intended target appliance performing the operation.

36. The readable media as recited in claim 35, wherein the instructions perform the step of receiving data that identifies the plurality of commands.

37. The readable media as recited in claim 35, wherein the instructions perform the step of transmitting at least a portion of the data to the remote control.

38. The readable media as recited in claim 35, comprising updating the data maintained within the recipient device only in cases where the transmission from the remote control is intended to command a toggled operation of the intended target appliance.

39. The readable media as recited in claim 35, wherein the instructions perform the step of placing the data into a known state upon receipt of a reset command.

40. The readable media as recited in claim 39, wherein the reset command is received via the remote control.

41. The readable media as recited in claim 39, wherein the reset command is received via manual activation of a reset button on the recipient device.

42. The readable media as recited in claim 35, wherein the plurality of commands comprise a locally stored command code set.

43. The readable media as recited in claim 42, wherein the plurality of commands are remotely stored and downloaded into local memory.

44. The readable media as recited in claim 42, wherein the plurality of commands are learned from the remote control.

45. The readable media as recited in claim 35, wherein the instructions perform the step of supplementing the data with information obtained directly from the intended target appliance.

46. The readable media as recited in claim 35, wherein the data is maintained within a state table.

47. The readable media as recited in claim 35, wherein the instructions perform the step of transmitting the data to a requesting personal computer.

48. The readable media as recited in claim 35, wherein the intended target appliance comprises the transmission monitoring device.

49. The readable media as recited in claim 35, wherein the data is maintained locally within the transmission monitoring device.

50. The readable media as recited in claim 35, wherein the data is maintain remotely from the transmission monitoring device.

51. A transmission monitoring system, comprising:

a remote control; and a transmission monitoring device;

wherein the remote control and the transmission monitoring device are adapted to bi-directionally communicate;

wherein the transmission monitoring device comprises a readable media having instructions for comparing a transmission from the remote control to a plurality of commands to determine if the transmission from the remote control is intended to command an operation of an intended target appliance and to update data to reflect a state of the intended target appliance which will result from the intended target appliance performing the operation, and for transmitting at least a portion of the data to the remote control; and wherein the remote control comprises a readable media having instructions for using data received from the transmission monitoring device to determine if a transmission of a sequence of macro commands requires alteration given the state of the intended target appliance as indicated by the data.

52. The system as recited in claim 51, wherein the readable media of the transmission monitoring device has instructions for receiving data that identifies the intended target appliance to thereby select the plurality of commands.

53. The system as recited in claim 51, wherein the readable media of the transmission monitoring device has instructions for updating the data maintained within the recipient device only in cases where the transmission from the remote control is intended to command a toggled operation of the intended target appliance.

54. The system as recited in claim 51, wherein the readable media of the transmission monitoring device has instructions for placing the data into a known state upon the receipt of a reset command.

55. The system as recited in claim 54, wherein the reset command is received via the remote control.

56. The system as recited in claim 54, wherein the reset command is received via manual activation of a reset button on the transmission monitoring device.

57. The system as recited in claim 51, wherein the plurality of commands are locally stored on the transmission monitoring device.

58. The system as recited in claim 51, wherein the plurality of commands are stored remotely and downloaded into a memory of the transmission monitoring device.

59. The system as recited in claim 51, wherein the plurality of commands are learned from the remote control.

60. The system as recited in claim 51, wherein the readable media of the remote control has instructions for using the data received from the transmission monitoring device to display a state of the intended target appliance.

61. The system as recited in claim 51, wherein the readable media of the remote control has instructions for accepting input that reflects an intended state for the intended target appliance in response to the remote control transmitting the macro command sequence.

62. The system as recited in claim 61, wherein the readable media of the remote control has instructions for using the received data to omit from the macro command sequence those commands that would cause the intended target appliance to be placed into a state other than the intended state.

63. The system as recited in claim 51, wherein the readable media of the transmission monitoring device has instructions for transmitting to the remote control all data.

64. The system as recited in claim 51, wherein the readable media of the transmission monitoring device has instructions for transmitting to the remote control at least a portion of the data in response to a query message received from the remote control.

* * * * *